United States Patent [19]

Dusch

[11] Patent Number: 4,691,650

[45] Date of Patent: Sep. 8, 1987

[54] LOCKSWITCH SEWING MACHINE HAVING A ROTARY HOOK

[75] Inventor: Albert Dusch, Kaiserslautern, Fed. Rep. of Germany

[73] Assignee: Pfaff Industriemaschinen GmbH, Fed. Rep. of Germany

[21] Appl. No.: 811,649

[22] Filed: Dec. 20, 1985

[30] Foreign Application Priority Data

Dec. 20, 1984 [DE] Fed. Rep. of Germany ..... 3446547

[51] Int. Cl.[4] ..... D05B 57/08; D05B 57/26

[52] U.S. Cl. ..... 112/231

[58] Field of Search ..... 112/184, 228, 229, 231

[56] References Cited

U.S. PATENT DOCUMENTS

| | | | |
|---|---|---|---|
| 1,917,771 | 7/1933 | Myers | 112/228 |
| 2,088,560 | 7/1937 | Parry | 112/228 |
| 2,866,425 | 12/1958 | Palmbach | 112/228 X |
| 3,138,127 | 6/1964 | Ketterer | 112/184 |
| 3,921,551 | 11/1975 | Gustmann et al. | 112/181 |
| 4,137,858 | 2/1979 | Stapel et al. | 112/181 |
| 4,292,906 | 10/1981 | Johnson | 112/184 |
| 4,524,708 | 6/1985 | Rodda et al. | 112/231 |

FOREIGN PATENT DOCUMENTS

| | | | |
|---|---|---|---|
| 2439214 | 2/1976 | Fed. Rep. of Germany | 112/228 |
| 3303033 | 8/1984 | Fed. Rep. of Germany | 112/184 |

*Primary Examiner*—Wm. Carter Reynolds
*Attorney, Agent, or Firm*—McGlew and Tuttle

[57] ABSTRACT

A lockstitch sewing machine includes a rotary hook. For the rotation secure retention of the bobbin housing of the hook, two cams are arranged in the central region of the loop cast-off side, which receive a spring rod between them. A shoulder formed at the bobbin housing is associated with the cam or with the spring rod. Through the special position of the cams, the movement resistances during the guiding of the needle thread loop around the bobbin housing is reduced to a minimum.

2 Claims, 4 Drawing Figures

LOCKSWITCH SEWING MACHINE HAVING A ROTARY HOOK

FIELD AND BACKGROUND OF THE INVENTION

The invention relates in general to sewing machines and in particular to a new and useful rotary hook arrangement for a lockstitch sewing machine.

A sewing machine similar to the invention is disclosed in U.S. Pat. No. 4,137,858 to Stepel et al. In the case of the rotary hook of this sewing machine the bobbin capsule carrier of the bobbin housing has a laterally projecting holding finger which for the rotationally secured retention of the bobbin housing engages between two cams disposed on the underside of the stitch plate near the stitch hole. Associated with the rotary hook is a spring rod clamped fixed, which cooperates with an abutment surface of a cutout in the bobbin capsule. The cutout is located at a distance before the holding finger in the direction of hook rotation. The spring rod is arranged and dimensioned so that the holding finger is approximately centered between the two cams when the sewing machine is running, so that a thread passage gap is formed on both sides of the holding finger. As a result, it is possible both at the beginning and at the end of the looping around the bobbin housing to move the needle thread loop through the rear and then through the front thread passage gap without using a capsule release device and without having to rotate the bobbin housing. During the looping of the needle thread loop the spring rod is merely bent back briefly by the needle thread. As the spring rod has little mass, it offers not appreciable resistance if the spring force is rated correctly.

Although the thread passage gaps are wide enough, after the guiding of the needle thread loop around the bobbin housing, a brief impediment of the thread movement occurs nevertheless during the upward pull-back. This is because the lower edge, turned toward the holding finger, of the front cam projects into the pull-off path of the needle thread loop and briefly retains the upwardly moved needle thread loop, which toward the end of the pull-back spins in part uncontrolled, until it snaps off the cam laterally into the thread passage gap. Due to this retention effect of the front cam, coming into play in particular at high rotational speed, the needle thread tension increased in an undesirable manner.

By German OS No. 33 03 033 to Rampack it is proposed to connect the holding finger which serves to prevent rotation of the bobbin housing firmly with the base plate outside the area of the stitch hole and to let its free end engage radially to the hook axis into a U-shaped cutout in the bobbin capsule. Preferably the holding finger is to be arranged diameterically to the stitch hole. By moving the holding means which serve to prevent rotation of the bobbin housing into a region diametrically opposite the stitch hole, it is now indeed possible to pull the needle thread loop upward unhindered after completed looping around the bobbin housing. However, then an impediment of the thread movement occurs during the guiding of the needle thread loop around the bobbin housing, in that it must squeeze through between the holding finger and the abutment faces of the cutout at the time of its greatest expansion.

Lastly there is known from German Pat. No. 31 02 457 a rotary hook revolving about a horizontal axis which to secure the bobbin housing against rotation is associated with a spring-loaded holding finger arranged on a support and with a cam on both sides of the holding finger. The holding finger and what in the direction of hook rotation is the rear cam span a finger formed at the bobbin capsule carrier. The front cam forms a support for the spring loaded holding finger. As the housing side holding means are arranged in the vicinity of the stitch hole, the pull-back of the needle thread loop is impeded, as in the case of the first named rotary hook, so that consequently one must operate with increased needle thread tension.

SUMMARY OF THE INVENTION

The invention provides a lockstitch sewing machine having a rotary hook where the holding means which prevent co-rotation and reverse rotation of the bobbin housing are arranged so that they hinder the guiding of the needle thread loop and in particular the pull-back occurring after its maximum expansion, as little as possible.

Since all housing side holding means are located on the loop cast-off side of the bobbin housing, the needle thread loop can be expanded totally unhindered until its maximum expansion is reached. On the loop cast-off side the needle thread loop is then pulled back by the thread take-up lever, the loop sliding at first still along the outer surface of the bobbin housing and thereafter along the front side face of the shoulder. In this manner the needle thread loop moves, without touching the front cam, through the gap between the latter and the shoulder and only thereafter it causes a brief bending of the low-mass spring rod. As little force is required for this, the bending of the spring rod causes only a slight increase of the needle thread tension. Since the rear cam serves only as a supporting element for the spring rod and comes in contact neither with the bobbin housing nor with the needle thread loop, the needle thread loop can, after having been moved through under the spring rod, be pulled back through the stitch hole by the thread feeder totally unhindered.

By a further feature of the invention, the slight impediment of the thread movement caused by the bending of the spring rod can be eliminated completely in that the capsule release device gives the bobbin housing a rotational impulse counter to the direction of hook rotation, so that the rear side face of the shoulder briefly moves away from the spring rod by the dimension of the thread thickness, so that the needle thread loop can slip through the thread passage gap thus created, entirely unhindered. In this case the needle thread tension required for satisfactory stitch formation can be reduced to a minimum. However, one must watch that during the reverse rotation of the bobbin housing the thread passage gap between the front side face of the shoulder and the front cam, serving as reverse rotation protection, remains large enough for the thread movement to take place unhindered as before at this point.

Accordingly it is an object of the invention to provide a rotary hook arrangement for a lockstitch sewing machine which includes first and second cams arranged on respective sides of a projection of the bobbin housing of a rotatable hook for controlling the rotation of the bobbin housing with the rotary hook housing which includes the spring rod extending between cams which cooperate with a projection of the housing.

A further object of the invention is to provide a rotary hook arrangement for a lockstitch sewing machine which is simple in design, rugged in construction and economical to manufacture.

The various feature of novelty which characterize the invention are pointed out with particularity in the claims annexed to and forming part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
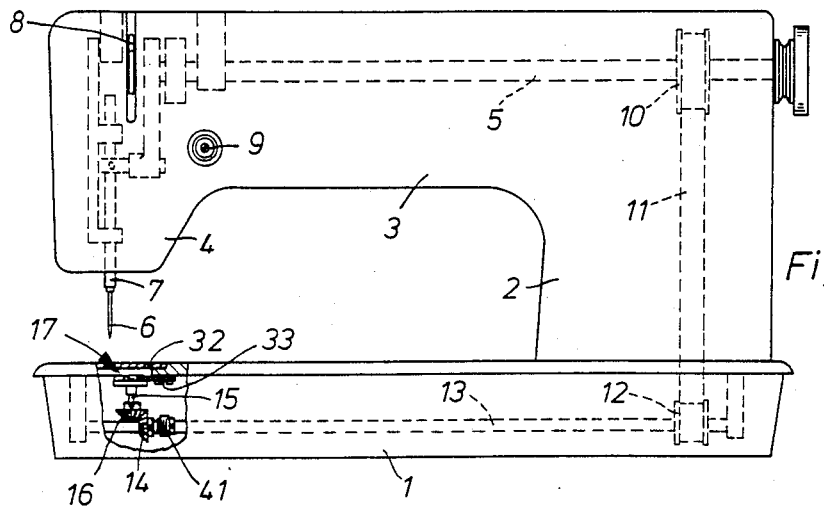
FIG. 1 is a side elevational view of a sewing machine constructed in accordance with the invention.
Figure 2:
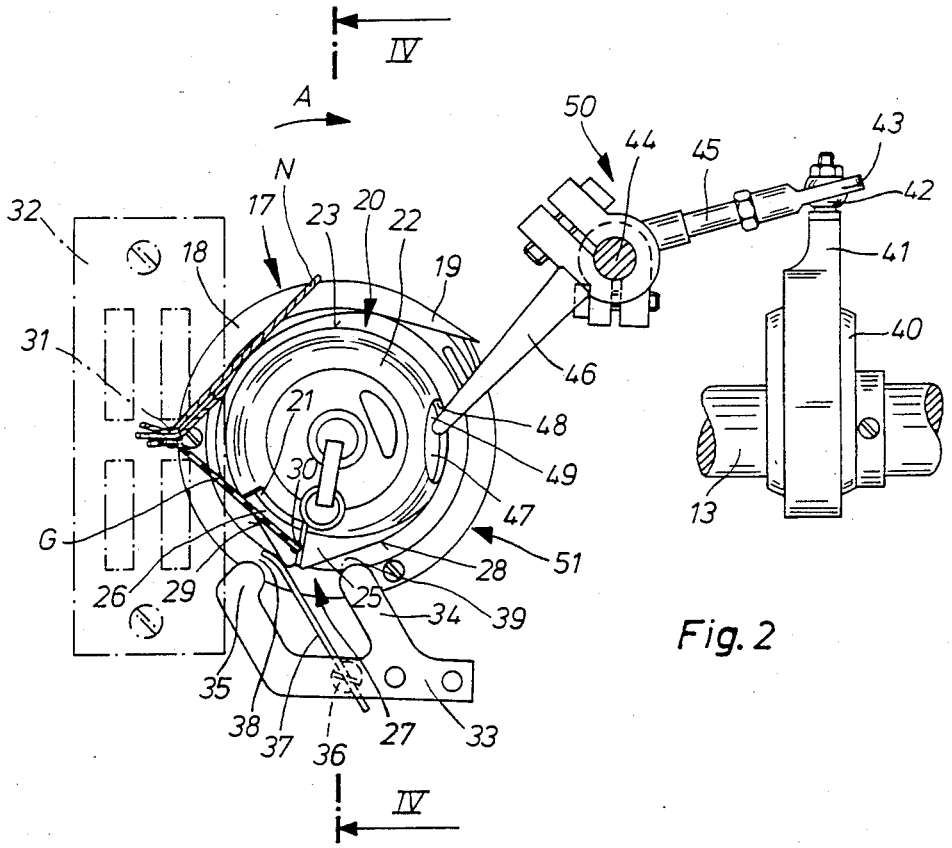
FIG. 2 is an enlarged elevational view of the rotary hook and the capsule release device.
Figure 3:
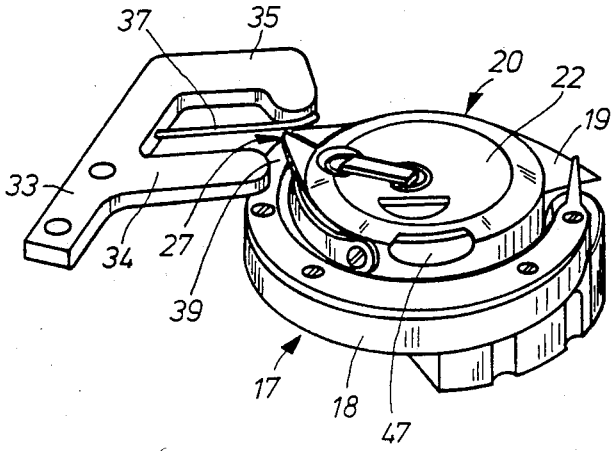
FIG. 3 is a perspective view of the rotary hook.
Figure 4:
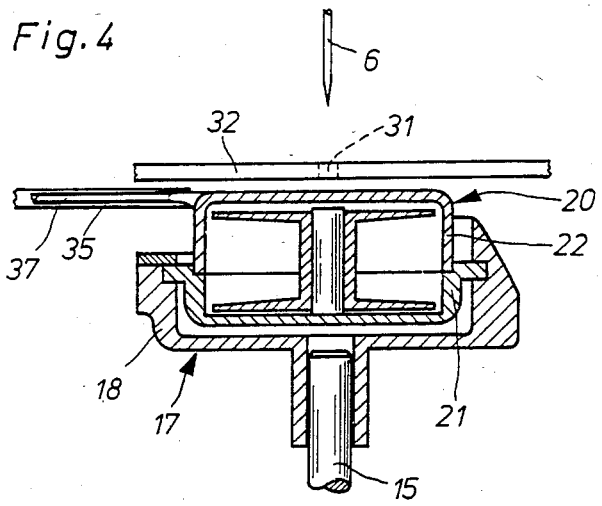
FIG. 4 is a side sectional view of the rotary hook taken along line IV—IV of FIG. 2.

Referring to the drawings in particular the invention embodied therein comprises a rotary hook arrangement shown in detail in FIGS. 2, 3 and 4 for a locksewing machine shown in FIG. 1.

The lockstitch sewing machine comprises a base plate 1, a standard 2, and an arm 3 with a head 4. In arm 3 is mounted an arm shaft 5, which is in drive connection with a needle bar 7 movable up and down in the head 4 and carrying a threaded needle 6. Also mounted in head 4 is the thread take-up lever 8, which in known manner cooperates with the needle 6 and executes an up and down movement, and which is also driven by an arm shaft 5. The head 4 carries a thread tensioning device 9.

Secured on the arm shaft 5 is a belt pulley 10 which, via a belt 11 and a belt pulley 12, transmits the drive movement of the arm shaft 5 to the rotary hook drive shaft 13 mounted in the base plate 1, in the ratio 1:1. Secured on the rotary hook drive shaft 13 is a bevel gear 14 which meshes with a counter-gear 16, disposed on the vertical rotary hook shaft 15 and thus drives the lockstitch rotary hook 17 disposed at the upper end of the hook shaft 15 and revolving in a horizontal plane.

The lockstitch rotary hook 17 has a hook body 18 and a hook tip 19 formed thereon. A bobbin housing 20 is supported in the hook body 18, and it comprises a bobbin capsule carrier 21 and a removable bobbin capsule 22. At the bobbin capsule 22 and at the bobbin capsule carrier 21, in the same plane, two projections 25,26 laterally projecting from the outer surface 23 of the bobbin housing 20 are arranged, which together form a triangular shoulder 27. The outer side face of projection 25 forms what in the direction of hook rotation A is the front side face 28 of shoulder 27. The outer side face of the projection 26 forms the, in direction A, rear side face 29 of shoulder 27. The front and rear side faces 28, 29 of the two projections 25, 26 jointly forming the shoulder 27 are tangential to the generated surface 23 of the bobbin housing 20.

In the bobbin housing 20, on a bobbin the rotary hook thread G is arranged in known manner. It runs through a thread opening 30 in projection 26 and thence to the stitch hole 31 of the stitch plate 32 recessed in top of the base plate 1. The shoulder 27 lies in the central region of the loop castoff side 51, of the bobbin housing 20. The loop castoff side 51 lies in the region of that half of the outer surface 23 which according to FIG. 2 lies outside a line conceived to extend through the stitch hole 31 and the axis of rotation of rotary hook 17.

At a carrier 33 attached to the base plate 1, a front cam 34, and, spaced therefrom a rear cam 35 is formed. By a screw 36, a spring rod 37 extending between the cams 34,35 is fastened to the carrier 33. The free end of the spring rod 37 is located between the rear side face 29 of shoulder 27 and the rear cam 35, leaving a gap between the free end of spring rod 37 and the free end of the rear cam 35. With the sewing machine running, the bobbin housing 20 takes support by engagement of the rear side face 29 of the shoulder 27 on the spring rod 37, whereby the rod hinders the bobbin housing 20 against co-rotating with the hook body 18. When the bobbin housing 20 abuts by the rear side face 29 against the spring rod 37, a relatively large gap 39 is formed between the free end of the front cam and the front side face 28 of shoulder 27.

On the hook drive shaft 13 an eccentric 40 is secured, which has a spherical circumferential surface. The eccentric 40 is spanned by one end of an eccentric rod 41, the other end of which is arranged at a crank 45 secured on a vertically mounted shaft 44. On shaft 44, a horizontally extending finger 46 is clamped, the free end of which projects a small distance into a cutout 47 in the bobbin capsule 22. The cutout 47 is offset relative to the stitch hole 31 of the stitch plate 32 by substantially 180°. Depending on the position of eccentric 40, a gap 49 exists between the finger 46 and an abutment surface 48 of cutout 47, or the finger 46 applies against the abutment surface 48 and in so doing rotates the bobbin housing 20 counter to the direction of hook rotation A. The parts 40 to 46 form a capsule release device 50.

The hook tip 19 having seized the needle thread loop N formed by needle 6 at the beginning of a stitch formation process, the loop is expanded by the revolving hook body 18 for looping around the bobbin housing 20, whereby the slack previously produced by the thread take-up lever 8 is used up. At the time of its greatest expansion the needle thread loop N moves through the gap 49 between the finger 46 and the abutment surface 48 without being hindered by finger 46. Thereafter the thread feeder 8 begins to pull back the needle thread loop N.

Immediately after the needle thread loop N has traversed the gap 49, the eccentric 40 moves the finger 46 against the abutment surface 48 and gives the bobbin housing 20 slight rotational impulse counter to the direction of hook rotation A. Due to this rotational impulse the bobbin housing 20 is rotated only so far counter to the direction of hook rotation A that there forms between the rear side face 29 and the spring rod 37 only a narrow gap approximately corresponding to the thickness of the needle thread, and the width of the gap 39 between the front side face 28 and the front cam 34 is reduced correspondingly little.

Although the angle distance between the abutment surface 48 for finger 46 and the point of contact of the spring rod 37 against the rear side face 29 is only about 120°, the capsule release device 50 can nevertheless create the gap between the rear side face 29 and the spring rod 37 in good time, namely due to the fact that the capsule release device 50 is driven at the same speed as rotary hook 17 and that the bobbin housing 20 is rotated back by only a relatively small amount.

In the course of the pull-back movement, the needle thread loop N drops off the hook tip 19, moves unhindered through the sufficiently wide gap 39, then slides almost jerklessly over the tip of the shoulder 27, and finally moves unhindered through the gap briefly created by the capsule release device 50 between the rear side face 29 and the free end of the spring rod 37. Thereafter the needle thread loop N is pulled back completely through the stitch hole together with a section of the hook thread G.

Since during its entire guiding movement around the bobbin housing 20 the needle thread loop N experiences no impediment except for the slight deflection around the shoulder 27, the rotary hook 17 is outstanding for an especially jerk-free and low friction motion of the needle thread loop N.

But also without the use of a capsule release device the rotary hook 17 has comparatively good sewing properties. In that case the low mass spring rod 37 is bent back by the amount of the thread thickness by the needle thread loop N. Since little force is required for the bending back if the spring rod 37 is suitably dimensioned, the motion of the needle thread loop N is hindered only correspondingly little. This force to be supplied by the thread take-up lever 8 and acting on the needle thread does indeed entail that the needle thread tension to be adjusted at the thread tension device 9 is somewhat higher than with the use of the capsule release device 50, the slightly increased needle thread tension is still definitely lower than with conventional rotary hooks.

While a specific embodiment of the invention has been shown and described in detail to illustrate the application of the principles of the invention, it will be understood that the invention may be embodied otherwise without departing from such principles.

What is claimed is:

1. A rotary hook arrangement for a lockstitch sewing machine, comprising a stitch plate having a stitch hole therein, a hook housing rotatably mounted on the sewing machine below said stitch plate, a bobbin housing freely rotatably supported in said hook housing, a bobbin capsule carrier forming part of said bobbin housing, a projection formed on said bobbin housing extending outwardly of an outer periphery thereof and having first and second space abutment surfaces, a carrier mounted on the sewing machine and having two spaced apart first and second cams adjacent said projection, a spring rod on said carrier extending between said cams and engaged against said first abutment surface, said first abutment surface cooperating with said first cam to secure said bobbin housing against forward rotation with said hook housing and said second cam cooperating with said second abutment surface to secure against reverse rotation of said bobbin housing with said hook housing, said first and second cams being arranged substantially at 90° upstream of said stitch hole in the direction of forward rotation and thus substantially in the central region of a loop cast-off side of said bobbin housing and receiving said spring rod therebetween, said first cam providing reinforcement for said spring rod, said projection abutment surfaces formed by side faces of said projection extending tangential to the outer periphery of said bobbin housing and defining a shoulder of said bobbin housing.

2. A rotary hook arrangement according to claim 1, including a capsule release device driven by the sewing machine and including a lever rotatably supported on said sewing machine and having a finger portion projecting outwardly, said bobbin housing having a cutout portion into which said finger extends, said stitch hole overlying the periphery of said bobbin housing, said bobbin housing having abutment surfaces formed in the cutout thereof which is offset relative to the stitch hole by substantially 180°.

* * * * *